United States Patent [19]

Funfstuck

[11] 4,301,950

[45] Nov. 24, 1981

[54] ROTATABLE CLOSURE FOR COLLAPSIBLE TUBES

[76] Inventor: Horst Funfstuck, 364 W. Payson St., Glendora, Calif. 91740

[21] Appl. No.: 150,007

[22] Filed: May 15, 1980

[51] Int. Cl.[3] ..... B65D 47/26

[52] U.S. Cl. ..... 222/548

[58] Field of Search ..... 222/548, 554, 556, 563

[56] References Cited

U.S. PATENT DOCUMENTS

| | | | |
|---|---|---|---|
| 1,537,399 | 5/1925 | Wiswell | 222/554 X |
| 1,685,147 | 9/1928 | Case | 222/548 X |
| 1,956,880 | 5/1934 | Stauffer | 222/554 X |
| 2,138,992 | 12/1938 | Baker | 222/548 X |
| 2,555,107 | 5/1951 | Beebe | 222/548 X |
| 2,682,355 | 6/1954 | Robbins | 222/554 X |
| 2,961,133 | 11/1960 | Ankney | 222/548 |
| 3,198,406 | 8/1965 | Kopelman | 222/548 X |

FOREIGN PATENT DOCUMENTS

| | | | |
|---|---|---|---|
| 2338701 | 2/1974 | Fed. Rep. of Germany | 222/548 |
| 642495 | 7/1962 | Italy | 222/554 |

*Primary Examiner*—David A. Scherbel

*Attorney, Agent, or Firm*—Francis X. LoJacono

[57] ABSTRACT

An adjustable cap for collapsible tubes and like containers, wherein the cap is secured to the container and is adjustable to an open and closed position, whereby the container or tube contents can be discharged without removing the cap. The adjustable cap includes a base-cap member adapted to be mounted to a tube or the like, and a rotatable body member that is formed having an aperture which is aligned with the discharge passage formed in the base-cap member when the cap body is rotated to an open position.

1 Claim, 10 Drawing Figures

FIG. 1
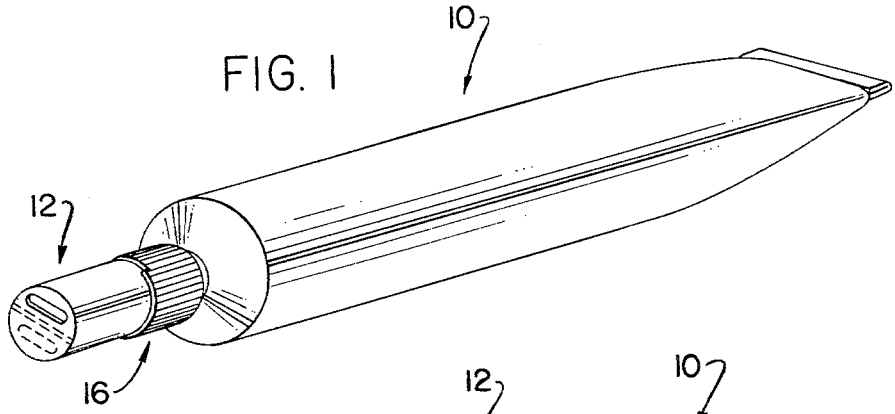
FIG. 2
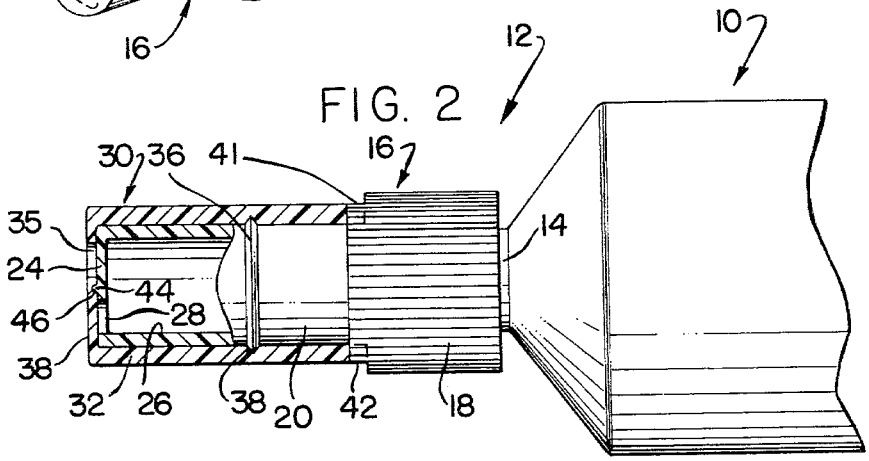
FIG. 3
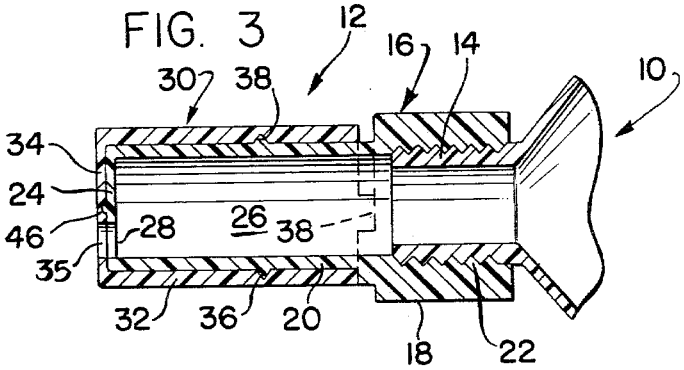
FIG. 6
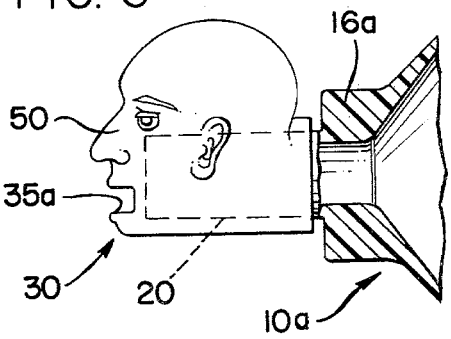
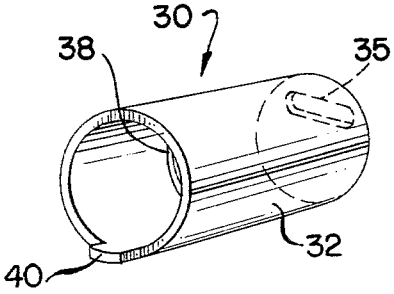
FIG. 4
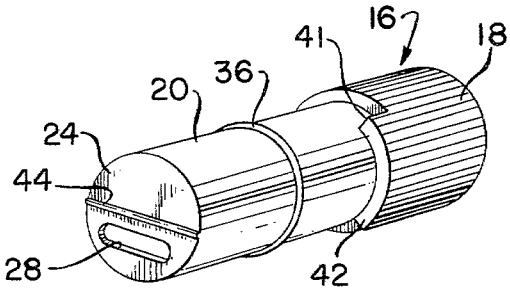
FIG. 5

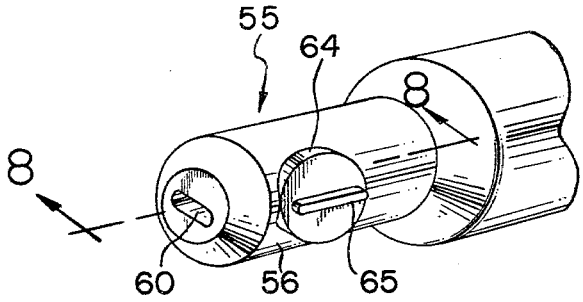
FIG. 7
FIG. 8
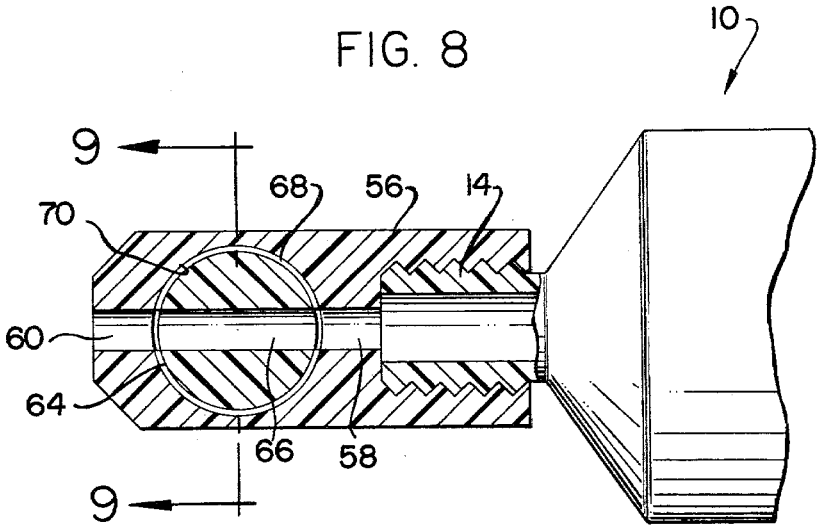
FIG. 9
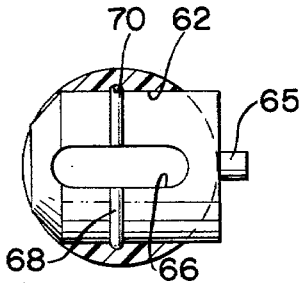
FIG. 10
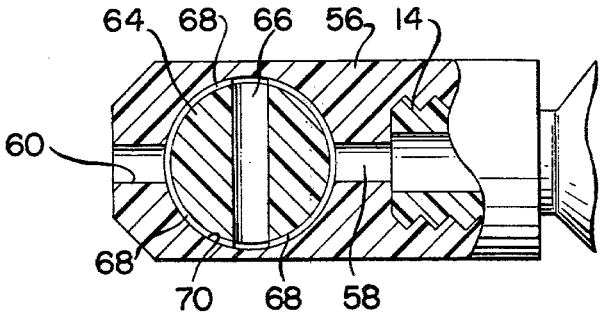

ROTATABLE CLOSURE FOR COLLAPSIBLE TUBES

BACKGROUND OF THE INVENTION

1. Field of the Invention

This invention relates generally to an improved dispenser closure for collapsible tubes and like containers.

2. Description of the Prior Art

As is well known in the art various problems and difficulties are encountered in providing suitable means for dispensing contents from tubes and like containers, particularly where the contents are in a paste or semi-liquid form.

Many types of dispenser-closure devices are in use, but these devices have features that very often restrict their use, and they are complicated to operate and expensive to manufacture.

As examples of various dispensing devices, the following United States patents are noted in the existing known art:

U.S. Pat. No. 3,876,118 to Adolfo A. Laredo comprises a rotary valve that rotates automatically when pressure increases in the dispenser, whereby the valve remains closed as long as the container is not in use.

U.S. Pat. No. 3,726,436 to Richard R. Despain, et al., discloses a dispenser having a flap valve which also can only operate when pressure is applied to its associated container.

Other patents of interest are U.S. Pat. Nos. 3,825,157; 4,139,124 and 2,546,709.

SUMMARY AND OBJECTS OF THE INVENTION

The present invention has for an important object to provide a device of this character that can readily replace the presently used caps for collapsible tubes, bottles, etc., by means of a closure mechanism or cap which remains attached to the container or tube, etc., whereby it is no longer necessary to unscrew the cap and screw it back onto the container after each use.

It is another object of the invention to provide an adjustable cap for dispensing material from collapsible tubes, etc., wherein the adjustable cap includes a base-cap member which is secured to the container and is adapted to receive a rotatable body member, one embodiment providing a cap housing having an off-set aperture that is arranged to be aligned with the discharge passage formed in the base member. A second embodiment, as herein disclosed, is provided with a rotatable body member that is formed as a transverse valve having a through aperture that is alignable with the discharge passage of its associated base member.

It is still another object of the invention to provide a cap dispenser of this type that allows for quick dispensing and prevents messiness due to dripping, and that further includes a positive closing and sealing.

It is a further object of the present invention to provide a dispensing cap that is each to operate—thus making it especially desirable for persons who are handicapped, such as arthritics, etc. The present device is further designed to reduce contact between the operator's hands and the dispensed product—an important feature when dispensing certain substances which might irritate the skin.

Still another object of the invention is to provide a device of this character wherein the contents can be dispensed in various cross-sectional configurations, such as round, triangular, star, rectangular, etc., by means of the configuration of the discharging aperture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of one embodiment of the invention secured to a collapsible tube;

FIG. 2 is an enlarged side-elevational view of the cap having a portion thereof broken away, to more clearly illustrate the construction thereof between the rotatable member and the base member;

FIG. 3 is a longitudinal cross-sectional view thereof, showing the cap dispenser in an open position for discharge of contents;

FIG. 4 is a perspective view of the valve housing;

FIG. 5 is a perspective view of the base member;

FIG. 6 is a perspective view of an alternative arrangement of the invention secured to a container;

FIG. 7 is a perspective view of another embodiment of the invention secured to a container;

FIG. 8 is a longitudinal cross-sectional view taken substantially along line 8—8 of FIG. 7, showing the rotatable valve in an open position;

FIG. 9 is a cross-sectional view taken on line 9—9 of FIG. 8; and FIG. 10 is a cross-sectional view similar to that of FIG. 8, showing the valve member in a closed position.

DESCRIPTION OF THE PREFERRED EMBODIMENT

Referring to FIGS. 1 through 6, and more particularly to FIG. 1, there is shown a container, generally indicated at 10, which is herein illustrated as a collapsible tube, such as used for toothpaste and other substances of like consistency. Secured to the dispensing end of tube 10 is one embodiment of the invention defining an adjustable dispensing-cap device, designated generally at 12.

The well-known type tube 10 is formed having a threaded discharge nozzle 14 to which cap device 10 is threadably mounted. The cap device comprises a base-cap member 16 having an enlarged head member 18 and a longitudinally extended neck member 20. Various means can be provided in head member 18 to secure it to a particular container, said means being herein shown as internal thread 22 adapted to receive threaded nozzle 14.

Neck member 20 is formed as a tubular body defining a discharge passage 26 having an end wall 24, in which a discharge aperture 28 is positioned. Aperture 28 is off-set from the central axis of passage 26.

Rotatably supported on neck member 20 is a body member 30 defining a valve housing 32 which is fitted over neck 20; and thus one end of housing 32 is open and the opposite end has a closure wall 34. Positioned within closure wall 34 is a discharge aperture 35 having a configuration matching aperture 28, aperture 35 being off-set from the longitudinal axis of housing 32. Thus, when housing 32 is rotated clockwise (see FIG. 2) aperture 35 is positioned above aperture 28, thereby closing the dispenser. FIG. 3 illustrates the two apertures 28 and 35 in a discharge alignment after housing 32 has been rotated counter-clockwise.

Means for rotatably securing housing 32 to neck 20 is provided by an annular rib 36 formed on the outer surface neck 20, the rib being fitted into an annular matching groove 38 formed in the inner surface of housing 32. It is contemplated that other securing means can be adapted between neck 20 and housing 32, and at the same time allow housing 32 to rotate.

Further included is means to limit the rotational movement of housing 32, whereby aperture 35 can be moved about a 180° axis so as to provide a positive closed or open position. The limiting means comprises a tab 40 extending outwardly from the open end of housing 32; and it is arranged to engage shoulders 41 and 42 formed on head member 18.

Between walls 24 of neck 20 and wall 34 of valve housing 32, there is provided a sealing means which comprises a lateral rib member 44 formed on the outer surface of wall 24 which is adapted to be received in a corresponding groove 46 located in the inner surface of wall 34.

The rib 44 and groove 46 are centrally positioned so that they mate with each other whenever the cap device is in a fully closed of fully opened position. Thus, if tube 10 is squeezed when the cap is in a closed position, the material therein can not be forced through the seal.

In FIG. 6, the rotatable body member 30 is shown having a particular form, such as a face 50, which includes a mouth 52 forming aperture 35*a*. Thus, it can be understood that various novel configurations can be produced in the forming of the valve housing. It is also contemplated that a suitable plastic material can be used for making each element of the device, and that base member 16*a* can be formed as an integral part of the container 10*a*.

Referring now to FIGS. 7 through 10, there is illustrated a second embodiment of an adjustable cap device, generally indicated at 55. In this arrangement, the valve-base-cap member 56 is formed having a longitudinal passage 58 which communicates with the threaded nozzle 14 of tube 10, passage 58 terminating with a discharge aperture 60. Base 56 can be of any suitable material, such as plastic, whereby the aperture 60 can be readily provided with any particular configuration, so that the discharging material can be accordingly provided with a corresponding decorative shape. Thus, the elongated form of aperture 60 is shown as an example.

Transversely disposed in base cap 56 is an enlarged bore 62 in which a rotatable body member 64 is positioned, the body member defining a valve plug having a means on one end thereof to rotate the valve plug 64 between an open and a closed position. This means is shown as a projecting handle 65. Thus, valve plug 64 includes a discharge aperture 66 which—when positioned in alignment with passage 58—allows material from tube 10 to be discharged through aperture 60, as seen in FIG. 8.

In FIG. 10, plug 64 is rotated 90°, thus preventing flow from passage 58. Also included in this arrangement is a sealing means comprising an annular rib member 68 formed about the central portion of plug 64, and adapted to be received in a mating annular groove 70 formed in bore 62. Rib 68 and groove 70 also provide a means for positioning the valve plug within base member 56.

Accordingly, both embodiments are designed to be compatible with dispensing not only pastes, but also liquids, powders, etc., found in different shaped containers.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An improved adjustable dispensing cap for a collapsible tube and like containers, comprising:

a cap-base member, defining the discharge end of said collapsible tube, having a longitudinal discharge passage formed therein, including an end wall having a first discharge aperture disposed therein;

a rotatable valve-body member, mounted to said cap-base member, having a second discharge aperture formed in the end wall thereof, so as to be arranged in an open position in alignment with said first discharge aperture, to allow discharge of a material from said tube;

a sealing means interposed between said cap-base member and said valve-body member, said sealing means comprising a lateral rib member formed on the outer surface of said end wall of said cap-base member, and adapted to be received in a corresponding groove located on the inner surface of said end wall of said valve body, said rib member and said groove being centrally positioned to mate with each other whenever said cap-base is in a fully closed or fully opened position;

means, for rotatably securing said valve body to said cap-base member, comprising an annular rib formed on said valve body and adapted to be received in an annular matching groove formed in said cap-base member; and means, for limiting the rotation of said valve body with respect to said cap-base member, wherein said limiting means comprises a projecting tab member formed on one end of said valve body, and a pair of spaced shoulders formed in said cap-base member, whereby said tab member engages said shoulders to establish a predetermined rotation of said valve body.

* * * * *